US008727475B2

(12) United States Patent
Bibl et al.

(10) Patent No.: US 8,727,475 B2
(45) Date of Patent: May 20, 2014

(54) CONTROL OF VELOCITY THROUGH A NOZZLE

(75) Inventors: Andreas Bibl, Los Altos, CA (US); Christoph Menzel, New London, NH (US); Corina Nistorica, San Jose, CA (US); Gregory DeBrabander, San Jose, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 809 days.

(21) Appl. No.: 12/564,618

(22) Filed: Sep. 22, 2009

(65) Prior Publication Data

US 2010/0079523 A1 Apr. 1, 2010

Related U.S. Application Data

(60) Provisional application No. 61/101,614, filed on Sep. 30, 2008.

(51) Int. Cl.
*B41J 29/393* (2006.01)

(52) U.S. Cl.
USPC ..... 347/19

(58) Field of Classification Search
USPC ..... 347/68, 19
See application file for complete search history.

(56) References Cited

U.S. PATENT DOCUMENTS

| | | | | |
|---|---|---|---|---|
| 3,916,226 | A | 10/1975 | Knoll | |
| 4,007,464 | A | 2/1977 | Bassous et al. | |
| 4,625,221 | A * | 11/1986 | Mizuno et al. | 347/9 |
| 4,704,675 | A * | 11/1987 | Jacobs et al. | 347/14 |
| 6,070,971 | A | 6/2000 | Usui et al. | |
| 6,134,746 | A | 10/2000 | Miller et al. | |
| 6,419,348 | B1 | 7/2002 | Kojima et al. | |
| 6,584,660 | B1 | 7/2003 | Shimogawa et al. | |
| 6,700,307 | B2 | 3/2004 | Kitahara | |
| 7,134,746 | B2 * | 11/2006 | Takahashi | 347/72 |
| 2003/0146956 | A1 | 8/2003 | Takahashi | |
| 2004/0080585 | A1 | 4/2004 | Iriguchi | |
| 2004/0239731 | A1 | 12/2004 | Satake | |
| 2005/0099467 | A1 | 5/2005 | Bibl et al. | |
| 2006/0158486 | A1 | 7/2006 | Bibl et al. | |

(Continued)

FOREIGN PATENT DOCUMENTS

| | | |
|---|---|---|
| CN | 101189131 | 5/2008 |
| JP | 56-067271 | 6/1981 |
| JP | 57-197175 | 12/1982 |
| JP | 01-237151 | 9/1989 |
| JP | H10-193613 | 7/1998 |
| JP | 2006-156987 | 6/2006 |

OTHER PUBLICATIONS

International Search Report and Written Opinion of the International Searching Authority, PCT Application Serial No. PCT/US2009/054026, Oct. 15, 2009, 8 pp.

(Continued)

*Primary Examiner* — Julian Huffman
(74) *Attorney, Agent, or Firm* — Fish & Richardson P.C.

(57) ABSTRACT

A method is described wherein one or more parameters are measured that affect the nozzle velocity at which a printing fluid is ejected from a pumping chamber through a nozzle. The printing fluid is contained in the pumping chamber actuated by deflection of a piezoelectric layer. A surface area of an electrode actuating the piezoelectric layer is reduced based at least in part on the measured one or more parameters. Reducing the surface area of the electrode reduces the actuated area of the piezoelectric layer.

22 Claims, 5 Drawing Sheets

(56) References Cited

U.S. PATENT DOCUMENTS

| | | | |
|---|---|---|---|
| 2007/0052764 | A1 | 3/2007 | Oku |
| 2007/0064037 | A1 | 3/2007 | Hawkins et al. |
| 2011/0242168 | A1 | 10/2011 | Bibl et al. |

OTHER PUBLICATIONS

International Preliminary Report on Patentability, PCT Application Serial No. PCT/US2009/054026, Apr. 14, 2011, 7 pp.

International Search Report and Written Opinion for PCT Application No. PCT/US2009/057846, mailed Mar. 31, 2010.

Office Action in Japanese Application No. 2011-53106, dated Dec. 4, 2012, 13 pages including English Translation.

U.S. Appl. No. 13/120,593, Office Action dated May 1, 2013, 15 pages.

Chinese Office Action, with English Translation, in Chinese Application No. 200980143675.9, issued Apr. 23, 2013, 29 pages.

Chinese Office Action, with English Translation, in Chinese Application No. 200980143675.9, mailed Dec. 17, 2013, 31 pages.

* cited by examiner

CONTROL OF VELOCITY THROUGH A NOZZLE

This application claims the benefit of pending U.S. Provisional Application Number 61/101,614, entitled "Control of Velocity Through a Nozzle", filed Sep. 30, 2008, and incorporated herein by reference in its entirety.

TECHNICAL FIELD

The following description relates to controlling a nozzle velocity.

BACKGROUND

A fluid ejection system, for example, an ink jet printer, typically includes an ink path from an ink supply to an ink nozzle assembly that includes nozzles from which ink drops are ejected. Ink is just one example of a fluid that can be ejected from a jet printer. Ink drop ejection can be controlled by pressurizing ink in the ink path with an actuator, for example, a piezoelectric deflector, a thermal bubble jet generator, or an electrostatically deflected element. A typical printhead module has a line or an array of nozzles with a corresponding array of ink paths and associated actuators, and drop ejection from each nozzle can be independently controlled. In a so-called "drop-on-demand" printhead module, each actuator is fired to selectively eject a drop at a specific location on a medium. The printhead module and the medium can be moving relative one another during a printing operation.

In one example, a printhead module can include a semiconductor printhead body and a piezoelectric actuator. The printhead body can be made of silicon etched to define pumping chambers. Nozzles can be defined by a separate substrate (i.e., a nozzle layer) that is attached to the printhead body. The piezoelectric actuator can have a layer of piezoelectric material that changes geometry, or flexes, in response to an applied voltage. Flexing of the piezoelectric layer causes a membrane to flex, where the membrane forms a wall of the pumping chamber. Flexing the membrane thereby pressurizes ink in a pumping chamber located along the ink path and ejects an ink drop from a nozzle at a nozzle velocity. The piezoelectric actuator is bonded to the membrane.

SUMMARY

This invention relates to controlling a nozzle velocity. In general, in one aspect, the invention features a method whereby one or more parameters affecting the nozzle velocity at which a printing fluid is ejected from a pumping chamber through a nozzle are measured. The printing fluid is contained in the pumping chamber, which is actuated by deflection of a piezoelectric layer. A surface area of an electrode actuating the piezoelectric layer is reduced based at least in part on the measured one or more parameters.

Implementations of the invention can include one or more of the following features. Measuring the one or more parameters can include measuring the thickness and capacitance of the piezoelectric layer. Reducing a surface area of the electrode can include determining the nozzle velocity, based at least in part on the measured thickness and capacitance of the piezoelectric layer, and reducing the surface area of the electrode based on a comparison of the nozzle velocity to a target velocity for the nozzle. Measuring the one or more parameters can include directly measuring an unloaded deflection of the piezoelectric layer. Reducing a surface area of the electrode can include determining the nozzle velocity based at least in part on the measured unloaded deflection of the piezoelectric layer, and reducing the surface area of the electrode based on a comparison of the nozzle velocity to a target velocity for the nozzle.

Measuring one or more parameters can include measuring a diameter of the nozzle. Reducing a surface area of the electrode can include determining the nozzle velocity based at least in part on the measured nozzle diameter, and reducing the surface area of the electrode based on a comparison of the nozzle velocity to a target velocity for the nozzle. Measuring one or more parameters can include measuring one or more flow path characteristics of the flow path of the printing fluid. Reducing a surface area of the electrode can include determining the nozzle velocity based at least in part on the measured one or more flow path characteristics, and reducing the surface area of the electrode based on a comparison of the nozzle velocity to a target velocity for the nozzle.

In general, in another aspect, the invention features a method that includes measuring one or more parameters of a piezoelectric layer positioned in contact with an electrode. Deflection of the piezoelectric layer deflects a boundary of a pumping chamber containing a printing fluid such that the printing fluid is ejected through a nozzle at a nozzle velocity. A surface area of the electrode is reduced based at least in part on the measured one or more parameters.

Implementations of the invention can include one or more of the following features. Reducing a surface area of the electrode can include estimating the nozzle velocity based on the one or more measured parameters of the piezoelectric layer, and reducing a surface area of the electrode based at least in part on a comparison of the nozzle velocity to a target velocity for the nozzle. Measuring one or more parameters can include measuring the capacitance and the thickness of the piezoelectric layer. Measuring one or more parameters can include measuring the unloaded deflection of the piezoelectric layer. Measuring the unloaded deflection can include applying a fixed amplitude sinusoidal voltage to the electrode and directly measuring the unloaded deflection with a laser vibrometer.

In general, in another aspect, the invention features a method wherein, for each nozzle of an array of nozzles driven by an array of actuators, one or more parameters are measured of a piezoelectric layer included in the actuator and positioned in contact with an electrode. Deflection of the piezoelectric layer deflects a membrane into a pumping chamber containing a printing fluid such that the printing fluid is ejected through the nozzle at a nozzle velocity. For each nozzle, based on the one or more measured parameters of the piezoelectric layer, the nozzle velocity of the nozzle is determined. An average velocity is calculated of the nozzles across the array of nozzles. The nozzle velocities of the nozzles are normalized to a target velocity. For each nozzle, if the normalized nozzle velocity is greater than the target velocity, then a difference is calculated between the normalized nozzle velocity and the target velocity. A surface area of the electrode is reduced based on the calculated difference.

Implementations of the invention can include one or more of the following features. A threshold amount by which a nozzle velocity shall be decreased can be determined. If the calculated difference between the normalized nozzle velocity and the target velocity is greater than the threshold amount, then the surface area of the electrode is reduced based on the threshold amount rather than the calculated difference.

In general, in another aspect, the invention features a method wherein a thickness and a capacitance are measured of a piezoelectric layer positioned in contact with an electrode. Deflection of the piezoelectric layer deflects a boundary of a pumping chamber containing a printing fluid such that the printing fluid is ejected through a nozzle at a nozzle velocity. A surface area of the electrode is reduced based at least in part on the measured thickness and capacitance of the piezoelectric layer.

Implementations of the invention can include one or more of the following features. Reducing a surface area of the electrode can include determining the nozzle velocity based at least in part on the measured thickness and capacitance of the piezoelectric layer, and the surface area of the electrode can be reduced based on a comparison of the nozzle velocity to a target velocity for the nozzle. Determining the nozzle velocity can be further based at least in part on a diameter of the nozzle. The surface area of the electrode can be reduced to decrease the nozzle velocity to a target velocity. The surface area of the electrode can be reduced by removing a portion of the electrode with a laser. A perimeter of the electrode is trimmed to reduce the surface area. One or more interior regions of the electrode can be removed to reduce the surface area. An end of the electrode can be removed to reduce the surface area.

Reducing a surface area of the electrode can include determining a volume of the printing fluid ejected through the nozzle based at least in part on the measured thickness and capacitance of the piezoelectric layer, and reducing the surface area of the electrode based on a comparison of the volume to a target volume for the nozzle.

In general, in another aspect, the invention features a method wherein a voltage is applied to an electrode positioned in contact with a piezoelectric layer, the electrode having a surface area. A deflection of the piezoelectric layer is measured in response to the applied voltage. A surface area of the electrode is reduced based at least in part on the measured deflection.

Implementations of the invention can include one or more of the following features. Reducing the surface area of the electrode can include, based at least in part on the measured deflection, determining a nozzle velocity at which a printing fluid is ejected from a pumping chamber through a nozzle when deflection of the piezoelectric layer deflects a boundary of the pumping chamber. A surface area of the electrode can be reduced based on a comparison of the nozzle velocity to a target velocity for the nozzle. An amount by which to reduce the surface area of the electrode can be determined such that the nozzle velocity is decreased to the target velocity. Determining the nozzle velocity can be further based at least in part on a diameter of the nozzle. The measured deflection can be an unloaded deflection and can be measured using, for example, a laser vibrometer.

Implementations of the invention can realize one or more of the following advantages. The velocities of nozzles across an array of nozzles can be controlled to achieve a substantially uniform velocity across the array. Variations in each actuator across an array of actuators can be compensated for so as to provide substantial uniformity in actuator performance across an array of actuators driving an array of nozzles. Variations in factors affecting the velocity, for example, piezoelectric material characteristics, e.g., d31 coefficient, the flow path characteristics or the nozzle diameter, can be compensated for to provide uniformity in nozzle velocity across an array of nozzles and drop mass uniformity can also be improved.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
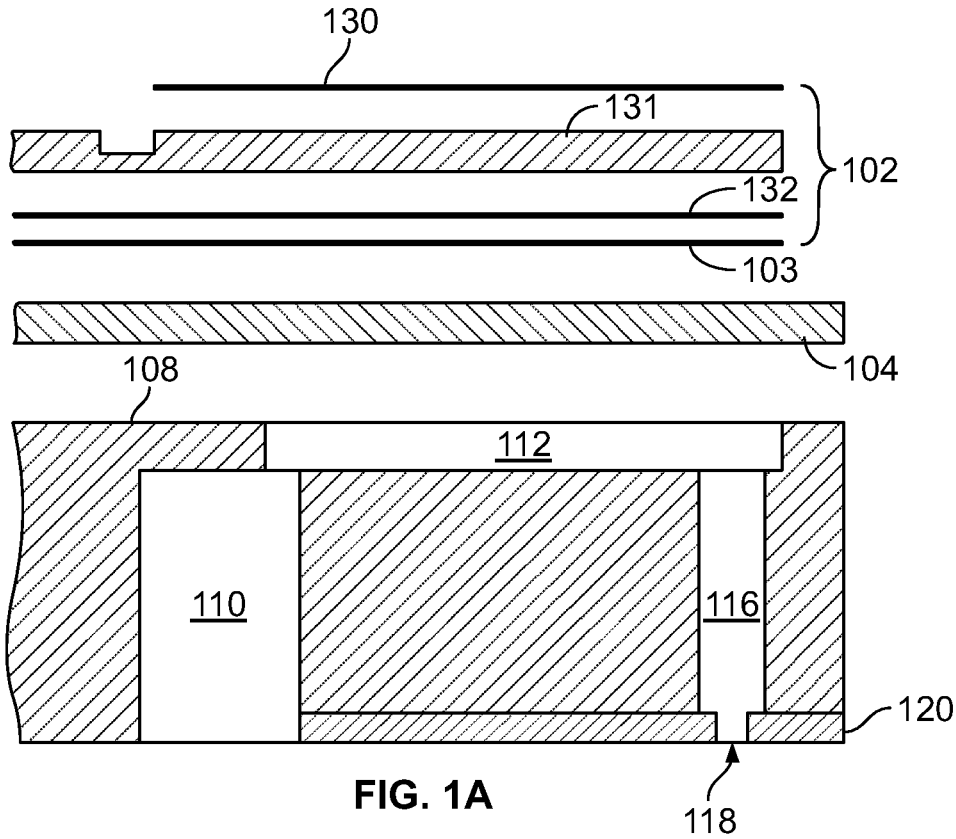
FIG. 1A is a cross-sectional partially exploded view of portion of an example printhead module including an actuator bonded to a membrane.
Figure 1B:
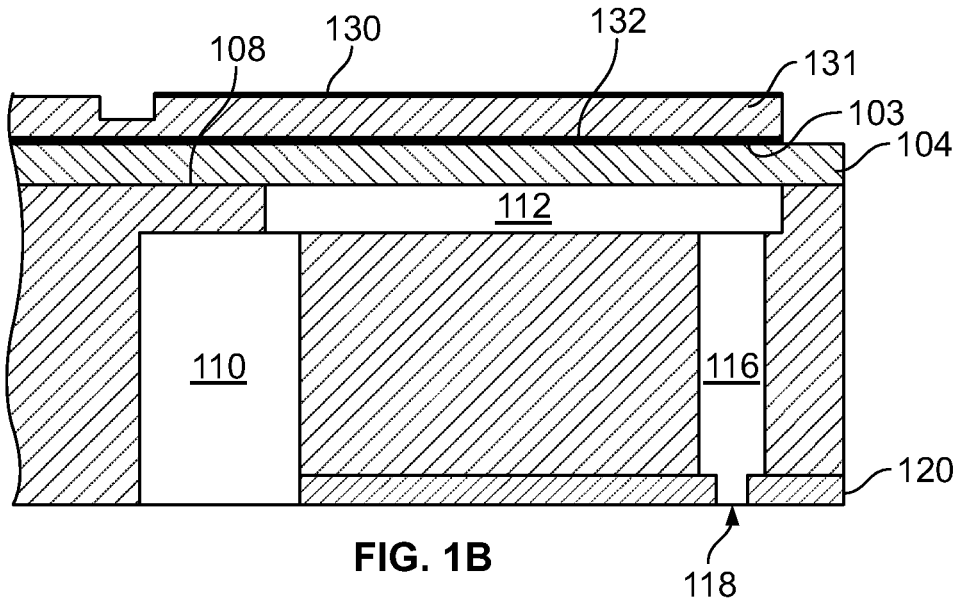
FIG. 1B is a cross-sectional view of the printhead module of FIG. 1A.

Methods are described for controlling the velocity of a printing fluid ejected from the nozzle on a printhead module. Referring to FIG. 1, for illustrative purposes only, and without being limited to the particular printhead module 100 shown, the techniques shall be described in the context of an actuator 102 bonded to a membrane 104. A cross-sectional view of a portion of the printhead module 100 is shown. The printhead module 100 includes a substrate 108 in which a plurality of fluid flow paths are formed (only one flow path is shown). The printhead module 100 also includes a plurality of actuators to cause fluid (e.g., ink) to be selectively ejected from the flow paths. Thus, each flow path with its associated actuator provides an individually controllable MEMS fluid ejector.

In this implementation of a printhead module, an inlet fluidically connects a fluid supply (not shown) to a substrate 108. The inlet is fluidically connected to an inlet passage 110 through a channel (not shown). The inlet passage 110 is fluidically connected to a pumping chamber 112. The pumping chamber 112 is fluidly connected to a descender 116 terminating in a nozzle 118. The nozzle 118 can be defined by a nozzle layer 120 attached to the substrate 108.

The membrane 104 is formed on top of the substrate 108 in close proximity to the pumping chamber 112, e.g. a lower surface of the membrane 104 can define an upper boundary of the pumping chamber 112. The actuator 102 is disposed on top of the membrane 104, and an adhesive 103 is between the actuator 102 and the membrane 104. It should be understood that in other implementations, the membrane 104 can be excluded, and the piezoelectric layer 130 itself can form a boundary of the pumping chamber 112. In implementations where the printing fluid can corrode the piezoelectric material, the surface forming the boundary of the pumping chamber can be protected by a protective layer, for example, a polyimide layer of Upilex® or Kapton®.

Figure 2:
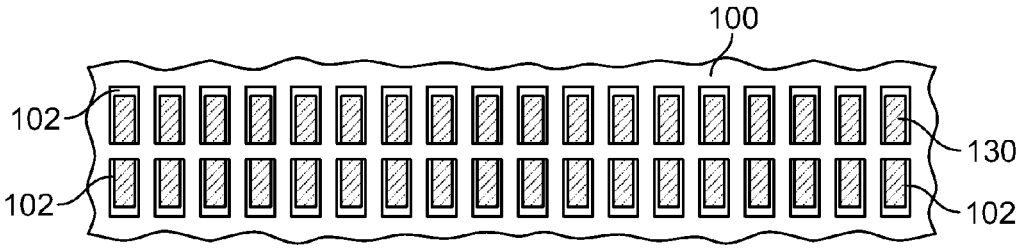
FIG. 2 is a plan view of a portion of an example printhead module showing rows of actuators positioned over rows of pumping chambers.

Referring to FIG. 2, a plan view is shown of a portion of the printhead module 100. In some implementations, each pumping chamber 112 has a corresponding electrically isolated actuator 102 that can be actuated independently. In this implementation, an array of actuators formed from two rows of actuators 102 is shown. The two rows of actuators 102 correspond to an array of two rows of pumping chambers 112, which can correspond to an array of two rows of nozzles 118 beneath the array of pumping chambers 112.

Figure 3A:
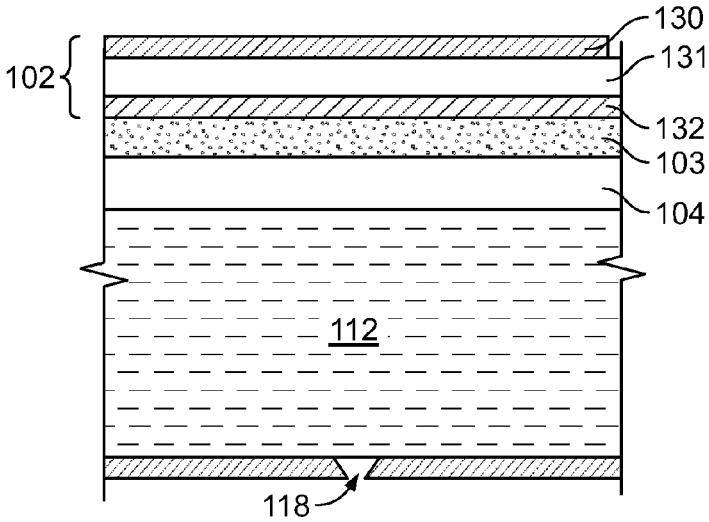
FIG. 3A is an enlarged cross-sectional view of a portion of the printhead module of FIGS. 1A and 1B.
Figure 3B:
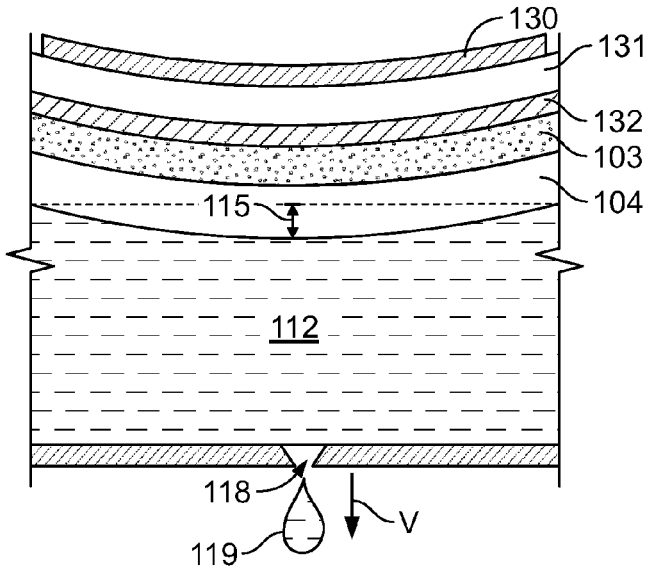
FIG. 3B is an enlarged cross-sectional view of the portion of the printhead module shown in FIG. 3A with a deflection in the membrane illustrated.

Referring to FIG. 3A, in this implementation, the actuator 102 includes a piezoelectric layer 131 between electrodes 130 and 132, to allow for actuation of the actuator 102 by a circuit (not shown). For example, electrode 130 can be a drive electrode and electrode 132 can be a ground electrode. A voltage applied to the drive electrode 130 creates a voltage differential across the piezoelectric layer 131, causing the piezoelectric material to deform, as shown in FIG. 3B. This deformation can deflect the membrane 104 by an amount 115 into the pumping chamber 112, thereby changing the volume of fluid in the pumping chamber 112. In response to the volume change in the pumping chamber, a drop 119 of fluid is ejected from the nozzle 118 of the printhead module at a velocity V.

Because the piezoelectric layer 131 is typically formed as a very thin layer, e.g., less than 50 microns that can be difficult to handle without damaging the layer, the actuator 102 can be formed in at least the following two ways, although other forming techniques are possible. In one technique, the ground electrode 132, is formed on the bottom of a relatively thick piezoelectric layer. In this implementation, the thick piezoelectric layer with the electrode 132 formed thereon is referred to herein as the "actuator layer", since it is not actually the actuator, but includes some components thereof at a stage in the actuator forming process. The actuator layer can then be bonded to the membrane 104, which is already bonded to substrate 108, using the bonding methods described herein. The thick piezoelectric layer can then be planarized to reduce the thickness to the desired thickness, i.e., to form the piezoelectric layer 131. The drive electrode 130, can then be formed on top of the piezoelectric layer 131.

In another technique, a relatively thick piezoelectric layer is formed on a support wafer. The piezoelectric layer is then planarized to reduce the thickness to the desired thickness, i.e., to form the piezoelectric layer 131. The support wafer provides the rigidity needed to form such a thin layer of the piezoelectric material. The exposed surface of the piezoelectric layer 131 is then metalized to form the ground electrode 132. In this implementation, the piezoelectric layer 131 attached to the support wafer and with the electrode 132 formed thereon is the "actuator layer". The actuator layer is bonded to the membrane 104 using the bonding methods described herein. The support wafer can then be removed from the piezoelectric layer 131. The newly exposed surface of the piezoelectric layer 131 can then be metalized to form the drive electrode 130.

The membrane 104 can be formed of silicon (e.g., single crystalline silicon), some other semiconductor material, oxide, glass, aluminum nitride, silicon carbide, other ceramics or metals, silicon-on-insulator, or any depth-profilable substrate. For example, the membrane 104 can be composed of an inert material and have compliance such that actuation of the actuator 102 causes flexure of the membrane 104 sufficient to pressurize fluid in the pumping chamber 112. In some implementations, the membrane 104 can have a thickness of between about 1 micron and about 150 microns. More particularly, in some implementations the thickness ranges between approximately 8 to 20 microns. U.S. Patent Publication No. 2005/0099467, entitled "Print Head with Thin Membrane" filed by Bibl et al on Oct. 8, 2004 and published May 12, 2005, the entire contents of which is hereby incorporated by reference, describes examples of printhead modules and fabrication techniques.

Referring again to the example printhead module shown in FIG. 1, in operation, fluid flows through the inlet into the substrate 108 and through the inlet passage 110. Fluid flows up the inlet passage 110 and into the pumping chamber 112. When the actuator 102 above the pumping chamber 112 is actuated, the actuator 102 deflects the membrane 104 into the pumping chamber 112. The resulting change in volume of the pumping chamber 112 forces fluid out of the pumping chamber 112 and into the descender 116. Fluid then passes through the nozzle 118, provided that the actuator 102 has applied sufficient pressure to force a droplet 119 of fluid through the nozzle 118. The droplet 119 of fluid is ejected at a velocity V and can then be deposited on a substrate.

The velocity at which the droplet 119 is ejected can be affected by a number of different factors. If a relationship between one or more factors affecting the velocity and the velocity can be determined (e.g., by regression modeling using empirical data), then the velocity can be estimated. For example, the performance of the actuator can affect the velocity. By taking one or more measurements correlating to the actuator's performance, the velocity can be estimated for a particular nozzle driven by a particular actuator based on the measurements. This and other examples are described in further detail below. If the estimated velocity is greater than a target velocity for the nozzle, the surface area of the drive electrode 130 can be reduced to decrease the voltage applied to the piezoelectric layer 131, which in turn decreases the deflection and therefore the nozzle velocity.

Although the discussion above is concerning the affect of various factors on the nozzle velocity, i.e., the velocity at which the drop is ejected from the nozzle, other drop characteristics can be correlated to the factors. For example, the volume of the drop ejected can be correlated to one or more of the various factors. In some implementations, achieving uniform drop volume is desired, and the drop volume may be measured and set as a target, rather than the velocity. Other drop characteristics are possible. For illustrative purposes, the discussion below is in the context of measuring or estimating the nozzle velocity and comparing it to a target velocity, however, it should be understood that a different drop characteristic can be used.

In one implementation, the affect of variations in the actuator are taken into consideration when determining how much to reduce the surface area of the drive electrode 130, if at all. Referring again to FIG. 3A, in the implementation shown, the piezoelectric actuator 102 includes the ground electrode 132, the piezoelectric layer 131, and the drive electrode 130. The piezoelectric layer 131 is a thin film of piezoelectric material and can have a thickness of about 50 microns or less, e.g. about 25 microns to 1 micron. In a particular example, the piezoelectric layer has a thickness in the range of approximately 8 to 18 microns.

Preferably, each nozzle in an array of nozzles ejects droplets at a uniform velocity. The velocity of the fluid ejected correlates at least in part to the performance of the actuator 102 driving the printing fluid through the nozzle. The performance of a piezoelectric actuator 102 can be described by two characteristics: (1) the unloaded deflection; and (2) the output impedance. The unloaded deflection is the amount by which the piezoelectric layer 131 deflects in response to an applied voltage with no load on the actuator (e.g., the pumping chamber is devoid of printing fluid). The output impedance is a measure of the ability of the actuator to drive something, e.g., to drive the printing fluid from the pumping chamber.

Variations in the unloaded deflection and the output impedance from one actuator can be affected by variations in the piezoelectric layer 131. While variations in other components of the actuator, e.g., the membrane 104, can also influence these variables, often it is variations in the piezoelectric layer 131 that are of significance. For example, the capacitance, thickness and/or d coefficient of the piezoelectric layer 131 can all be related to the unloaded deflection and the output impedance.

Since the values of these parameters can vary from actuator to actuator within an array of actuators, the velocity of each nozzle within a corresponding array of nozzles can also vary. To compensate for the variance in the values of these parameters across the array of nozzles, the surface area of the drive electrode 130 in an actuator 102 can be reduced. Reducing the surface area of the drive electrode 130 reduces the actuated area of the piezoelectric layer 131 and therefore reduces the deflection of the piezoelectric layer 131 and the corresponding deflection 115 of the membrane 104. Reducing the deflection 115 of the membrane 104 thereby reduces the velocity ($V_{nozzle}$) at which a droplet 119 is ejected from the nozzle 118. Accordingly, this technique can be used to reduce the nozzle velocity of each nozzle on a nozzle-by-nozzle basis, to compensate for the variance in the piezoelectric layer parameters discussed above.

The drive electrode 130 is a planar structure positioned over a pumping chamber and can have various shapes. In the example shown, the drive electrode is a rectangular shape. However, in other implementations, the drive electrode 130 can be circular, oval, elliptical, or otherwise configured. How the electrode is trimmed to reduce the surface area of the electrode can vary depending on the configuration of the electrode. For example, in the drive electrode 130 shown having a rectangular configuration, an end can be removed or electrically isolated from the rest of the electrode. In this particular implementation, there is generally a direct relationship between the actuated area of the piezoelectric layer and the nozzle velocity. However, in other implementations, that is not the case. Empirical data relating the surface area of the drive electrode 130 to the nozzle velocity can be collected and regression modeling techniques, which may be guided by a physical interpretation of how the printhead module operates, can be used to deduce a relationship between the surface area and the nozzle velocity. The relationship can be used to then determine how much of the drive electrode to trim to achieve a target nozzle velocity. As mentioned, the drive electrode is a planar structure, and can include a thin drive line extending form the electrode. The trimming of the surface area of the electrode occurs on the large planar area. The trim pattern can vary, depending on the particular configuration of the electrode.

Figure 4:
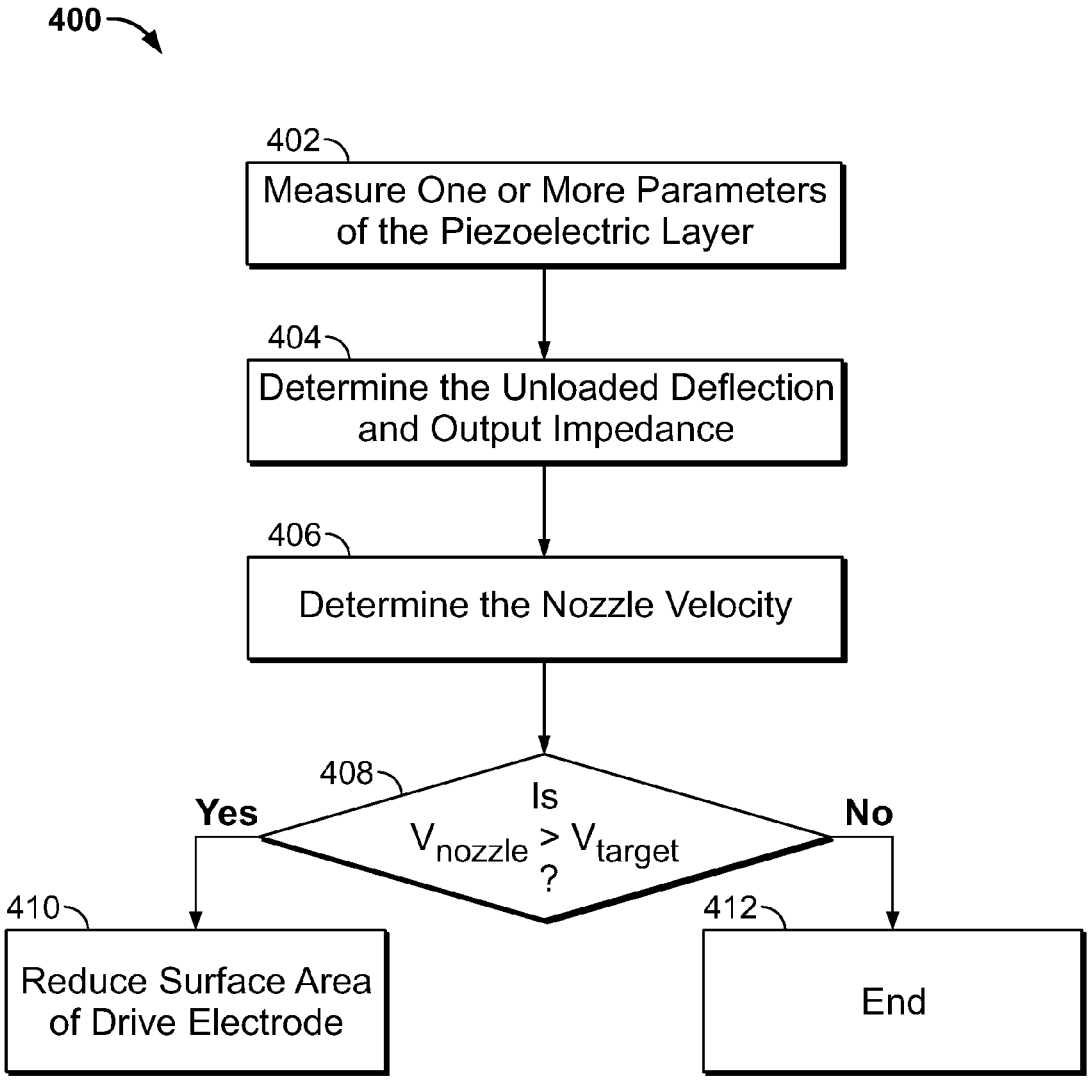
FIG. 4 is a flowchart showing an example process for reducing a surface area of an electrode.

Referring to FIG. 4, an example process 400 is shown for controlling the velocity of a nozzle. One or more parameters relating to the piezoelectric layer 131 can be measured (Step 402) and used to determined the unloaded deflection and output impedance of the actuator (Step 404). The velocity of the nozzle being driven by the actuator can be determined (or at least estimated) based either directly or indirectly on the unloaded deflection and output impedance of the actuator (Step 406). A comparison of the nozzle velocity to a target velocity for the nozzle can be used to determine if the nozzle velocity needs to be decreased (Step 408) and by how much. The surface area of the drive electrode can then be reduced to reduce the voltage applied to the piezoelectric layer and therefore reduce the amount of deflection of the piezoelectric layer, thereby decreasing the nozzle velocity and/or drop volume (Step 410). Otherwise, if the nozzle velocity is less than or equal to the target velocity, the process ends (Step 412).

Figure 5:
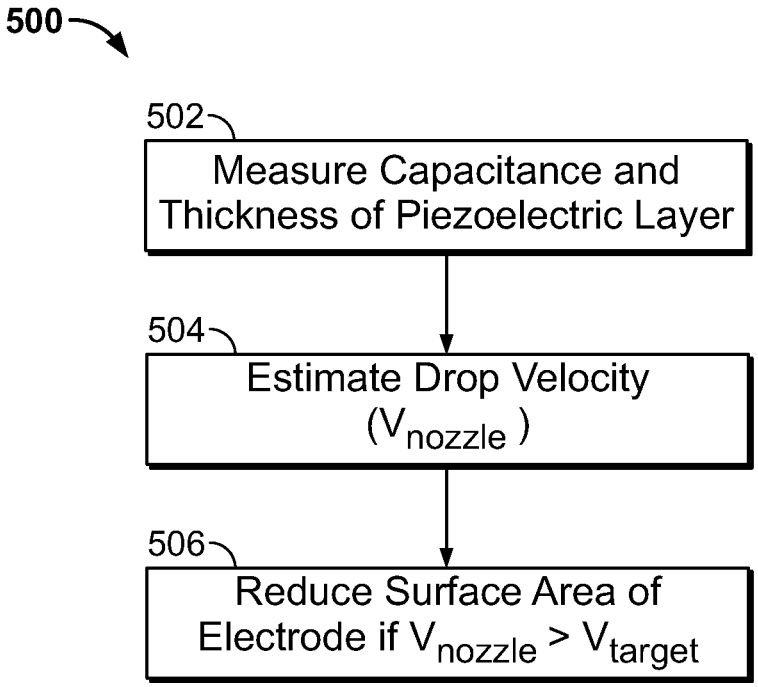
FIG. 5 is a flowchart showing an example process for determining a nozzle velocity.

In some implementations, the parameters of capacitance and thickness of the piezoelectric layer 131 are measured and can be used to determine the unloaded deflection and the output impedance of the actuator and/or to estimate the nozzle velocity. FIG. 5 shows an example process 500 for reducing the surface area of a drive electrode based on the capacitance and thickness of the piezoelectric layer 131. For the particular nozzle, the capacitance and thickness of the piezoelectric layer are measured (Step 502). The capacitance can be measured using any convenient technique, for example, a capacitance meter in conjunction with a wafer probe system. The thickness can be measured using any convenient technique, for example, a filmetric optical measurement device.

The velocity $V_{nozzle}$ is then estimated based on the measured capacitance and thickness of the piezoelectric layer (Step 504). In one implementation, empirical data can be gathered showing various capacitance and thickness values and nozzle velocities. Regression modeling techniques, which may be guided by a physical interpretation of how the printhead module operates, can be used to deduce relationships between the capacitance and thickness of the piezoelectric layer 131 and the nozzle velocity. The measured capacitance and thickness from Step 504 can be input into the model and the nozzle velocity thereby estimated. If the velocity $V_{nozzle}$ is greater than a predetermined target velocity of each nozzle in the array, then the surface area of the electrode is reduced to decrease the velocity $V_{nozzle}$ to achieve the target velocity (Step 506). If the velocity $V_{nozzle}$ is less than or equal to the target velocity, then the surface area is not changed. The target velocity can be predetermined based on various factors, including for example, design considerations and/or the application for which the printhead module is being used.

In other implementations, as mentioned above, regression modeling techniques can be used to deduce relationships between the capacitance and thickness of the piezoelectric layer 131 and the volume of a drop ejected from the nozzle. The measured capacitance and thickness can be input into the model and the drop volume thereby estimated. If the drop volume exceeds a predetermined target volume for the nozzle, then the surface area of the electrode can be reduced to decrease the drop volume to achieve the target volume.

The surface area of the drive electrode 130 can be reduced using any convenient technique. In one implementation, the drive electrode 130 is laser trimmed. For example, if the drive electrode 130 is formed by metalizing a surface of the piezoelectric layer 131, portions of the metalized surface forming the drive electrode can be removed using a laser. For example, an end of the drive electrode can be trimmed off to reduce the overall surface area of the electrode. In other examples, the drive electrode 130 is trimmed about the perimeter of the drive electrode 130. In other examples, the surface area of the drive electrode is reduced by removing interior portions of the drive electrode 130, e.g., making "holes" in the electrode. In some implementations, a portion of the drive electrode 130 can be electrically isolated from the portion of the electrode 130 that receives the drive voltage, and as such the voltage is not applied to the isolated portion. The surface area of the drive electrode 130 subjected to the drive voltage is thereby reduced, even though the isolated portion of the electrode is not physically removed. For example, if the drive electrode 130 is a metalized layer formed on the piezoelectric layer, a strip of the metalized layer can be removed to electrically isolate an end of the drive electrode 130 from the another end that receives the drive voltage.

In one implementation, a laser device available from Electro Scientific Industries, Inc. (ESI) of Portland, Oreg., is used to trim the electrode. The component including the electrode formed on the piezoelectric layer is positioned on a stage that can move the component relative to the laser. For example, the stage can be a product from Electroglas, Inc. A processor executing a software application can be used to control both the laser device and the stage, to position the component relative to the wafer during the trimming process.

Figure 6:
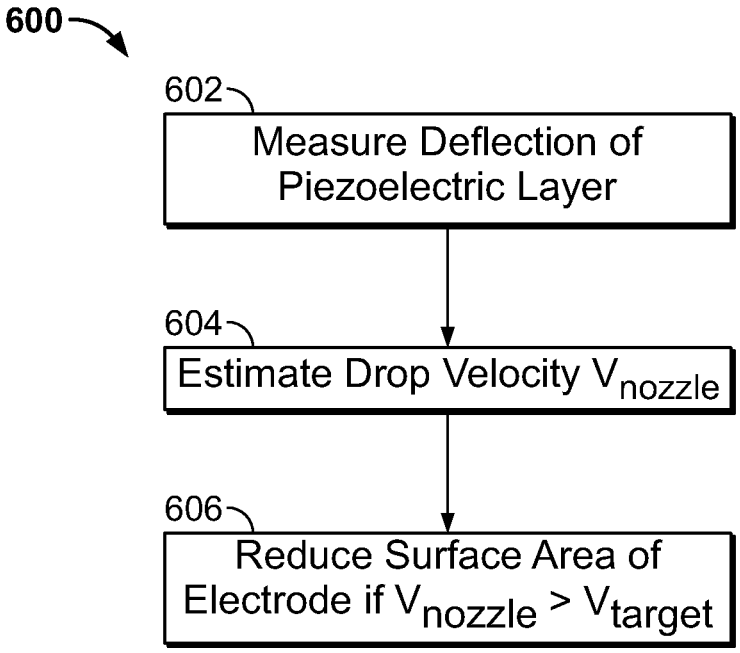
FIG. 6 is a flowchart showing an alternative example process for determining a nozzle velocity.

In Referring to FIG. 6, another example process 600 is shown for reducing the surface area of a drive electrode to control the velocity of a nozzle. In this implementation, the parameter of the piezoelectric layer 131 measured is the unloaded deflection when a voltage is applied to the drive electrode 130 (Step 602). For example, a laser vibrometer can be used to measure the deflection of the piezoelectric layer 131 in response to the voltage applied to the drive electrode 130 and the voltage can be a fixed amplitude sinusoidal voltage. Because the unloaded deflection is measured directly, rather than estimated based on other measurements (e.g., capacitance and thickness), the various influences on the deflection are taken into account, including, for example, the piezoelectric coefficient of the piezoelectric layer. In some instances, it has been found that a variation of 4% in the d coefficient can translate into an 8% variation in the drop velocity.

The velocity $V_{nozzle}$ can be estimated based on the unloaded deflection of the piezoelectric layer 131 alone, for example, if the output impedance is a constant. In some implementations, the output impedance can be substantially constant across an array of actuators. Whether or not the output impedance varies can depend, for example, on the manufacturing technique of the actuator. A technique that includes grinding the piezoelectric layer as compared to a technique that sputters a piezoelectric layer can result in greater variations in the output impedance across an array of actuators. For some manufacturing implementations of the actuator, the output impedance can be assumed a constant. In such implementations, the laser vibrometer measurement of the unloaded deflection can be sufficient to estimate the nozzle velocity.

In one implementation, empirical data can be gathered showing various unloaded deflection values and nozzle velocities. Regression modeling techniques, which may be guided by a physical interpretation of how the printhead module operates, can be used to deduce relationships between the unloaded deflection of the piezoelectric layer 131 and the nozzle velocity. The measured unloaded deflection from Step 602 can be input into the model and the nozzle velocity thereby estimated. In implementations where a variation in output impedance is expected, measuring one or more other parameters can be used to determine the output impedance, e.g., the capacitance and/or thickness of the piezoelectric layer.

In either instance, the velocity $V_{nozzle}$ is determined (Step 604) and can be compared to a target velocity. If the velocity $V_{nozzle}$ is greater than a predetermined target velocity of each nozzle in the array, then the surface area of the drive electrode 130 can be reduced to decrease the velocity $V_{nozzle}$ to achieve the target velocity (Step 606). If the velocity $V_{nozzle}$ is less than or equal to the target velocity, then the surface area of the drive electrode 130 is not changed.

In other implementations, as mentioned above, regression modeling techniques can be used to deduce relationships between the measured unloaded deflection of the piezoelectric layer 131 and the volume of a drop ejected from the nozzle. The measured unloaded deflection can be input into the model and the drop volume thereby estimated. If the drop volume exceeds a predetermined target volume for the nozzle, then the surface area of the electrode can be reduced to decrease the drop volume to achieve the target volume.

Two techniques for measuring or estimating the unloaded deflection of the piezoelectric layer 131 are described above, i.e., indirectly by proxy using the thickness and capacitance of the piezoelectric layer, or directly using a laser vibrometer. It should be understood that other techniques can be used for direct measurement, for example and without limitation: a two-dimensional interferometer; a laser Doppler; reflection (Keyence); or confocal microscopy. In terms of indirect measurement, the dielectric constant, a proxy for the piezoelectric coefficient, can be used to estimate the unloaded deflection. In terms of the output impedance, other techniques can be used to estimate the value of this characteristic, including for example (and without limitation): applying pressure and measuring deflection or, by proxy variables, for example, the thickness of the piezoelectric layer or the resonant frequency of the piezoelectric layer, which can be measured electrically or mechanically.

In some implementations, the affect of variations in the nozzle diameters of nozzles across an array are taken into consideration when determining how much to reduce the surface area of the drive electrode 130, if at all. For example, the smaller the diameter of the nozzle, the faster the nozzle velocity. In some implementations, the diameter of the nozzle can be factored into determining the amount by which to reduce the surface area of the drive electrode 130. That is, if a nozzle diameter of D1 would require the surface area of the drive electrode 130 to be reduced by an amount A1 to achieve a particular target velocity, and a particular nozzle has a diameter less than D1, then the amount of surface area trimmed from the drive electrode 130 should be less than A1 to achieve the target velocity.

In some implementations, the diameter of the nozzle can be used together with the measured capacitance and thickness of the piezoelectric layer 131 to determine the velocity $V_{nozzle}$ of the nozzle. In other implementations, the diameter of the nozzle can be used together with the measured unloaded deflection of the piezoelectric layer 131 to determine the velocity $V_{nozzle}$ of the nozzle. In other implementations, the diameter of the nozzle can be used alone to determine the velocity $V_{nozzle}$ of the nozzle. The diameter can be measured using any convenient technique, for example, optically or mechanically. The diameter can be estimated in some implementations. For example, if the nozzle is formed in a silicon layer using KOH etching, then knowing certain parameters about the layer and the etching process, the nozzle diameter can be predicted.

In some implementations, empirical data can be gathered to determine the relationship between the drop velocity and the diameter of the nozzle. The measured value of the nozzle diameter can then be compared to the empirical data and the velocity $V_{nozzle}$ thereby estimated, based on either the nozzle diameter alone or in combination with the measured capacitance and thickness of the piezoelectric layer or the measured deflection of the piezoelectric layer. Based on the velocity $V_{nozzle}$, the amount to trim the surface area of the drive electrode 130 can be determined. In either case, if the velocity $V_{nozzle}$ is greater than a predetermined target velocity of each nozzle in the array, then the surface area of the electrode is reduced to decrease the velocity $V_{nozzle}$ to achieve the target velocity, otherwise, the surface area is unchanged.

In other implementations, as mentioned above, regression modeling techniques can be used to deduce relationships between the nozzle diameter and the volume of a drop ejected from the nozzle. The nozzle diameter can be input into the model and the drop volume thereby estimated. If the drop volume exceeds a predetermined target volume for the nozzle, then the surface area of the electrode can be reduced to decrease the drop volume to achieve the target volume.

In some implementations, the affect of variations in the flow path characteristics of flow paths corresponding to nozzles across an array of nozzles are taken into consideration when determining how much to reduce the surface area of the drive electrode 130, if at all. For example, the dimensions of the flow path, such as the length, width and/or height, can all affect the velocity of the nozzle in which the flow path terminates. In some implementations, regression modeling techniques based on empirical data can be used to determine the relationship between one or more flow path characteristics and the nozzle velocity. The measured values of the flow path characteristic can then be compared to the empirical data and the velocity $V_{nozzle}$ thereby estimated, based on either the flow path characteristics alone or in combination with the other measurements, e.g., the capacitance and thickness of the piezoelectric layer or the measured deflection of the piezoelectric layer. Based on the velocity $V_{nozzle}$, the amount to trim the surface area of the drive electrode 130 can be determined. In either case, if the velocity $V_{nozzle}$ is greater than a predetermined target velocity of each nozzle in the array, then the surface area of the electrode is reduced to decrease the velocity $V_{nozzle}$ to achieve the target velocity, otherwise, the surface area is unchanged.

In other implementations, as mentioned above, regression modeling techniques can be used to deduce relationships between the flow path characteristics and the volume of a drop ejected from the nozzle. The measured flow path characteristics can be input into the model and the drop volume thereby estimated. If the drop volume exceeds a predetermined target volume for the nozzle, then the surface area of the electrode can be reduced to decrease the drop volume to achieve the target volume.

Reducing the surface area of the drive electrode 130 has the effect of decreasing the velocity $V_{nozzle}$. Accordingly, since the velocity $V_{nozzle}$ can only be decreased, to achieve a uniform velocity across an array of nozzles, the velocity $V_{nozzle}$ of each nozzle (other than the slowest nozzle) would need to be adjusted to the slowest velocity $V_{nozzle}$ within the array. However, in practice, it may not be preferred to decrease the velocity of every nozzle other than the slowest nozzle. For example, in an array of several hundred nozzles, a design tolerance may allow for 10 "slow" nozzles. Accordingly, the velocity of the "$11^{th}$ slowest" nozzle can be used as the target velocity.

Figure 7:
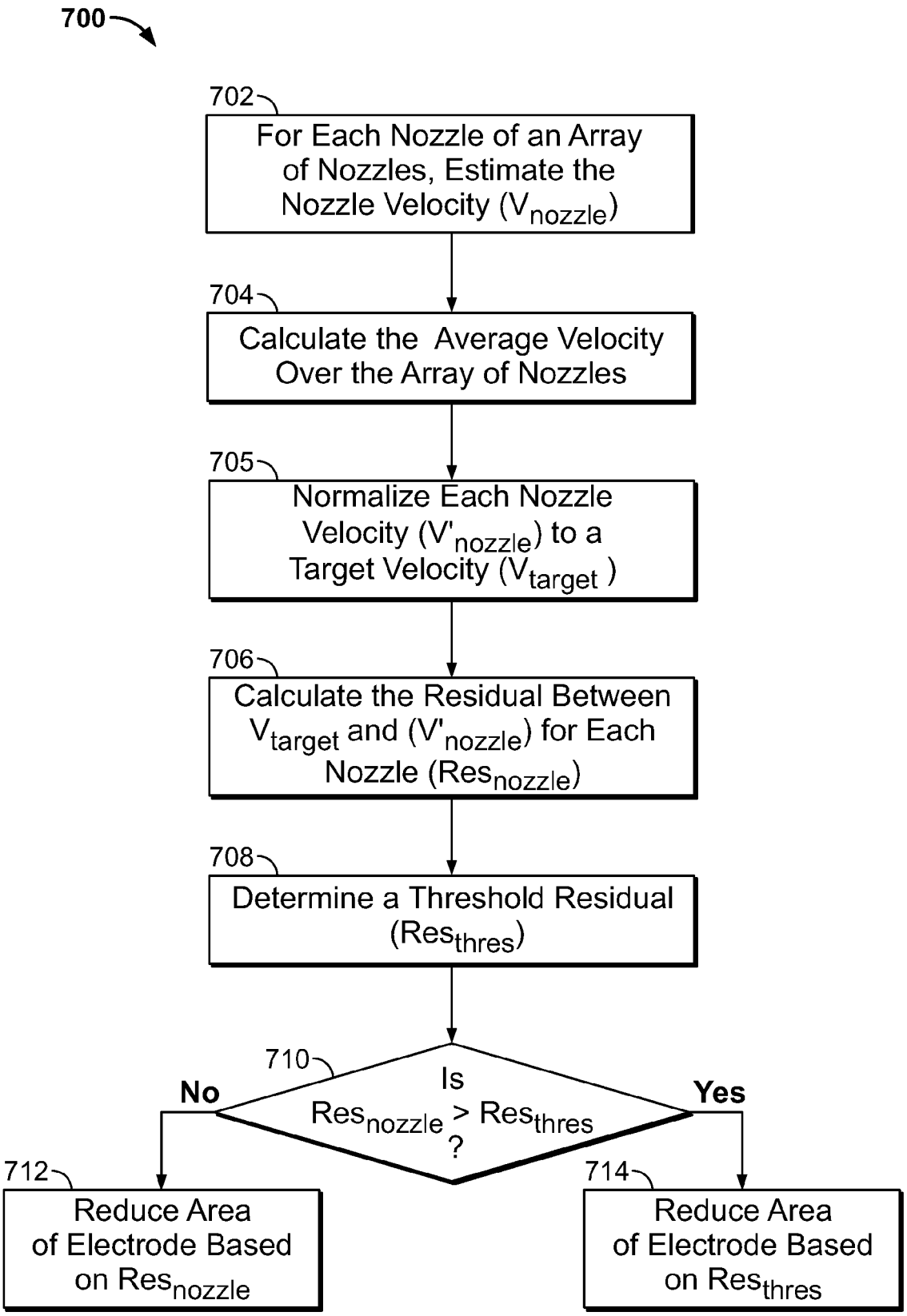
FIG. 7 is a flowchart showing an example process for reducing surface areas of an array of electrodes.

Referring to FIG. 7, an example process 700 is shown for determining by how much a nozzle velocity should be decreased. In this implementation, for each nozzle the velocity $V_{nozzle}$ is determined, for example, using one of the techniques described above in reference to FIGS. 5 and 6 (Step 702). The average velocity of the nozzles in the array is calculated (Step 704). In some implementations, the average velocity can be normalized to a target velocity ($V_{target}$) (Step 705). In one example, if the average velocity is 9 m/s and the target velocity is selected as 8 m/s, then $V_{nozzle}$ for each nozzle can be decreased by 1 m/s to normalize the average nozzle velocity to the target velocity. The adjusted nozzle velocity is referred to hereinafter as $V'_{nozzle}$. For each nozzle, a residual value is calculated ($Res_{nozzle}$), being the difference between $V'_{nozzle}$ and $V_{target}$ (Step 706). By way of illustrative example, if $V'_{nozzle}$ equals 8.5 m/s and $V_{target}$ equals 8 m/s, then $Res_{nozzle}$ is 0.5 m/s. That is, the surface area of the drive electrode for this nozzle should be reduced enough such that the velocity of the nozzle decreases by 0.5 m/s.

Optionally, in some implementations, a threshold residual ($Res_{thres}$) can be determined for the entire array of nozzles (Step 708). For each nozzle in the array, if the $Res_{nozzle}$ is greater than the $Res_{thres}$ ("Yes" branch of Step 708), then the surface area of the drive electrode 130 for the corresponding nozzle is reduced based on the $Res_{nozzle}$. However, if the $Res_{nozzle}$ is less than the $Res_{thres}$. ("No" branch of Step 708), then the surface area of the drive electrode 130 is reduced based on the $Res_{thres}$.

By way of illustration, consider an example where $V'_{nozzle}$ is 9 m/s and $V_{target}$ is set as the slowest nozzle in the array and is 4 m/s. $Res_{nozzle}$ is therefore calculated as 5 m/s. That is, for this particular nozzle, the velocity must be decreased by 5 m/s to achieve the target velocity. However, it is not always preferred to decrease the velocity of every nozzle, and a threshold residual can be selected being the maximum by which the velocity of any particular nozzle will be decreased. For example, in this instance the $Res_{thres}$ may be 3 m/s. If $Res_{nozzle}$ is greater than $Res_{thres}$, then the velocity is only decreased by $Res_{thres}$. In the particular illustrative example above, since $Res_{nozzle}$ is 5 m/s, which is greater than the $Res_{thres}$ of 3 m/s, the velocity of the nozzle will be decreased only 3 m/s from 9 m/s to 6 m/s, rather than all the way to the target velocity of 4 m/s. If $Res_{nozzle}$ is equal to or less than $Res_{thres}$, then the velocity is decreased by the $Res_{nozzle}$ amount.

In some implementations, the piezoelectric layer can be composed of a piezoelectric material that has desirable properties such as high density, low voids, and high piezoelectric constants. These properties can be established in a piezoelectric material by using techniques that involve firing the material prior to bonding it to a substrate. For example, piezoelectric material that is molded and fired by itself (as opposed to on a support) has the advantage that high pressure can be used to pack the material into a mold (heated or not). In addition, fewer additives, such as flow agents and binders, are typically required. Higher temperatures, 1200-1300° C. for example, can be used in the firing process, allowing better maturing and grain growth. Firing atmospheres (e.g. lead enriched atmospheres) can be used that reduce the loss of PbO (due to the high temperatures) from the ceramic. The outside surface of the molded part that may have PbO loss or other degradation can be cut off and discarded. The material can also be processed by hot isostatic pressing (HIPs), during which the ceramic is subject to high pressures, typically 1000-2000 atm. The Hipping process is typically conducted after a block of piezoelectric material has been fired, and is used to increase density, reduce voids, and increase piezoelectric constants.

Thin layers of prefired piezoelectric material can be formed by reducing the thickness of a relatively thick wafer. A precision grinding technique such as horizontal grinding and chemical mechanical polishing (CMP) can produce a highly uniform thin layer having a smooth, low void surface morphology. In horizontal grinding, a workpiece is mounted on a rotating chuck and the exposed surface of the workpiece is contacted with a horizontal grinding wheel.

The grinding and polishing can produce flatness and parallelism of, e.g., 1 micron or less, e.g. about 0.5 micron or less and surface finish to 5 nm Ra or less (e.g., 1 nm) over a wafer. The grinding also produces a symmetrical surface finish and uniform residual stress. Where desired, slight concave or convex surfaces can be formed. In some implementations, the piezoelectric wafer can be bonded to a substrate, such as the module substrate, prior to grinding so that the thin layer is supported and the likelihood of fracture and warping is reduced.

In some implementations, the density of the piezoelectric material is about 7.8 g/cm$^3$ or more, e.g., about 8 g/cm$^3$ to 10 g/cm$^3$. The $d_{31}$ coefficient can be about 300. The piezoelectric material, in one example, is a CTS 5A piezoelectric material.

The electrodes 130, 132 can be metal, such as copper, gold, tungsten, nickel-chromium (NiCr), indium-tin-oxide (ITO), titanium or platinum, or a combination of metals. The metals may be vacuum-deposited onto the piezoelectric layer 131. The thickness of the electrode layers may be, for example, about 2 micron or less, e.g. about 0.5 micron.

The membrane 104 is typically an inert material and has compliance so that actuation of the piezoelectric layer causes flexure of the membrane 104 sufficient to pressurize fluid in the pumping chamber. The thickness uniformity of the membrane 104 provides accurate and uniform actuation across the module. The membrane material can be provided in thick plates (e.g. about 1 mm in thickness or more) which are ground to a desired thickness using horizontal grinding. For example, the membrane 104 may be ground to a thickness of about 2 to 50 microns. In some embodiments, the membrane 104 has a modulus of about 60 gigapascal or more. Example materials include glass or silicon.

In the implementations discussed above, the actuator layer includes a piezoelectric layer with an electrode formed thereon, and the electrode facing surface is bonded to the membrane. In other implementations, the electrode can instead be formed on the membrane and the adhesive can be spun-on to the piezoelectric layer to bond the piezoelectric layer to the membrane. In this implementation, the adhesive layer is formed between the lower electrode (e.g., electrode 132) and the piezoelectric layer (e.g., layer 131).

The use of terminology such as "front" and "back" and "top" and "bottom" throughout the specification and claims is for illustrative purposes only, to distinguish between various components of the printhead module and other elements described herein. The use of "front" and "back" and "top" and "bottom" does not imply a particular orientation of the printhead module. Similarly, the use of horizontal and vertical to describe elements throughout the specification is in relation to the implementation described. In other implementations, the same or similar elements can be orientated other than horizontally or vertically as the case may be.

A number of embodiments of the invention have been described. Nevertheless, it will be understood that various modifications may be made without departing from the spirit and scope of the invention. For example, the steps in the process 300 can be performed in a different order than shown and still achieve desired results. Accordingly, other embodiments are within the scope of the following claims.

What is claimed is:

1. A method comprising:

measuring two or more parameters affecting a nozzle velocity at which a printing fluid is ejected from a pumping chamber through a nozzle, wherein in operation the pumping chamber is actuated by deflection of a piezoelectric layer to eject the printing fluid contained in the pumping chamber, and wherein measuring the two or more parameters comprises measuring a thickness and capacitance of the piezoelectric layer;

determining whether the nozzle velocity needs to be adjusted based at least in part on the measured two or more parameters; and when it is determined that the nozzle velocity needs to be adjusted, reducing a surface area of a top, drive electrode that actuates the piezoelectric layer based at least in part on the measured two or more parameters.

2. The method of claim 1, wherein reducing the surface area of the top, drive electrode that actuates the piezoelectric layer reduces an actuated area of the piezoelectric layer.

3. The method of claim 1, wherein determining whether the nozzle velocity needs to be adjusted based at least in part on the measured two or more parameters comprises determining the nozzle velocity based at least in part on the measured thickness and capacitance of the piezoelectric layer; and wherein reducing the surface area of the top, drive electrode comprises reducing the surface area of the top, drive electrode based on a comparison of the determined nozzle velocity to a target velocity for the nozzle.

4. The method of claim 1, wherein measuring two or more parameters comprises measuring one or more flow path characteristics of a flow path of the printing fluid.

5. The method of claim 4, wherein determining whether the nozzle velocity needs to be adjusted based at least in part on the measured two or more parameters comprises determining the nozzle velocity based at least in part on the measured one or more flow path characteristics; and wherein reducing the surface area of the top, drive electrode comprises reducing the surface area of the top, drive electrode based on a comparison of the determined nozzle velocity to a target velocity for the nozzle.

6. The method of claim 1, wherein determining whether the nozzle velocity needs to be adjusted comprises calculating the nozzle velocity by inputting both the capacitance and the thickness into a function that models a relationship of nozzle velocity to both the capacitance and the thickness.

7. A method comprising:

measuring two or more parameters of a piezoelectric layer positioned in contact with top, drive electrodes, wherein each top drive electrode corresponds to a pumping chamber, wherein in operation deflection of the piezoelectric layer deflects a boundary of the pumping chamber such that printing fluid contained in the pumping chamber is ejected through a nozzle at a nozzle velocity, and wherein measuring the two or more parameters comprises measuring a thickness and capacitance of the piezoelectric layer;

determining whether the nozzle velocity of fluid drops ejected from a particular pumping chamber needs to be adjusted based at least in part on the measured two or more parameters of the piezoelectric layer; and when it is determined that the nozzle velocity needs to be adjusted, reducing a surface area of the top, drive electrode corresponding to the particular pumping chamber based at least in part on the measured two or more parameters.

8. The method of claim 7, wherein the top, drive electrode actuates the piezoelectric layer, and wherein reducing the surface area of the top, drive electrode reduces an actuated area of the piezoelectric layer.

9. The method of claim 7, wherein determining whether the nozzle velocity needs to be adjusted comprises estimating the nozzle velocity based on the two or more measured parameters of the piezoelectric layer; and wherein reducing the surface area of the top, drive electrode comprises reducing the surface area of the top, drive electrode based at least in part on a comparison of the estimated nozzle velocity to a target velocity for the nozzle.

10. The method of claim 7, wherein determining whether the nozzle velocity needs to be adjusted comprises calculating the nozzle velocity by inputting both the capacitance and the thickness into a function that models a relationship of nozzle velocity to both the capacitance and the thickness.

11. A method comprising:

for each nozzle of an array of nozzles driven by an array of actuators, measuring two or more parameters of a piezoelectric layer included in the actuators and positioned in contact with an array of top, drive electrodes, wherein each top, drive electrode corresponds to a nozzle, wherein in operation, deflection of the piezoelectric layer deflects a membrane into a pumping chamber containing a printing fluid such that the printing fluid is ejected through the nozzle at a nozzle velocity, and wherein measuring the two or more parameters comprises measuring a thickness and capacitance of the piezoelectric layer;

for each nozzle, based on the two or more measured parameters of the piezoelectric layer, estimating the nozzle velocity of the nozzle;

calculating an average velocity of the nozzles across the array of nozzles;

normalizing nozzle velocities of the nozzles to a target velocity;

for each nozzle, if the normalized nozzle velocity is greater than the target velocity, then calculating a difference between the normalized nozzle velocity and the target velocity; and reducing a surface area of the top, drive electrode that corresponds to the nozzle based on the calculated difference.

12. The method of claim 11, wherein reducing the surface area of the top, drive electrode that actuates the piezoelectric layer reduces an actuated area of the piezoelectric layer.

13. The method of claim 11, further comprising:

determining a threshold amount by which a nozzle velocity shall be decreased; and if the calculated difference between the normalized nozzle velocity and the target velocity is greater than the threshold amount, then reducing the surface area of the top, drive electrode based on the threshold amount rather than the calculated difference.

14. A method comprising:

measuring a thickness and a capacitance of a piezoelectric layer positioned in contact with top, drive electrodes, wherein each top, drive electrode corresponds to a pumping chamber, and wherein in operation, deflection of the piezoelectric layer deflects a boundary of a pumping chamber containing a printing fluid such that the printing fluid is ejected through a nozzle at a nozzle velocity; and reducing a surface area of a top, drive electrode based at least in part on the measured thickness and capacitance of the piezoelectric layer.

15. The method of claim 14, wherein reducing the surface area of the top, drive electrode that actuates the piezoelectric layer reduces an actuated area of the piezoelectric layer.

16. The method of claim 14, wherein reducing the surface area of the top, drive electrode comprises:

determining the nozzle velocity based at least in part on the measured thickness and capacitance of the piezoelectric layer;

reducing the surface area of the top, drive electrode based on a comparison of the determined nozzle velocity to a target velocity for the nozzle.

17. The method of claim 16, wherein the surface area of the top, drive electrode is reduced to decrease the determined nozzle velocity to a target velocity.

18. The method of claim 14, wherein the surface area of the top, drive electrode is reduced by removing a portion of the top, drive electrode with a laser.

19. The method of claim 14, wherein a perimeter of the top, drive electrode is trimmed to reduce the surface area.

20. The method of claim 14, wherein one or more interior regions of the top, drive electrode are removed to reduce the surface area.

21. The method of claim 14, wherein an end of the top, drive electrode is removed to reduce the surface area.

22. The method of claim 14, wherein reducing the surface area of the top, drive electrode comprises:

determining a volume of the printing fluid ejected through the nozzle based at least in part on the measured thickness and capacitance of the piezoelectric layer;

reducing the surface area of the top, drive electrode based on a comparison of the determined volume to a target volume for the nozzle.

* * * * *

UNITED STATES PATENT AND TRADEMARK OFFICE

CERTIFICATE OF CORRECTION

PATENT NO. : 8,727,475 B2
APPLICATION NO. : 12/564618
DATED : May 20, 2014
INVENTOR(S) : Bibl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 983 days.

Signed and Sealed this
Eleventh Day of August, 2015

Michelle K. Lee

Michelle K. Lee
*Director of the United States Patent and Trademark Office*